US009068136B2

(12) United States Patent
Ohno et al.

(10) Patent No.: US 9,068,136 B2
(45) Date of Patent: Jun. 30, 2015

(54) LUBRICATING OIL COMPOSITION FOR HIGH-TEMPERATURE APPLICATIONS

(75) Inventors: Takuya Ohno, Ichihara (JP); Tahei Okada, Ichihara (JP); Hideto Kamimura, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 308 days.

(21) Appl. No.: 13/635,996

(22) PCT Filed: Mar. 17, 2011

(86) PCT No.: PCT/JP2011/056337

§ 371 (c)(1),
(2), (4) Date: Sep. 19, 2012

(87) PCT Pub. No.: WO2011/115193

PCT Pub. Date: Sep. 22, 2011

(65) Prior Publication Data

US 2013/0012417 A1 Jan. 10, 2013

(30) Foreign Application Priority Data

Mar. 19, 2010 (JP) ..... 2010-064315

(51) Int. Cl.

*C10M 105/32* (2006.01)
*C10M 107/08* (2006.01)
*C10M 169/04* (2006.01)

(52) U.S. Cl.

CPC ..... *C10M 169/04* (2013.01); *C10M 2205/026* (2013.01); *C10M 2205/0265* (2013.01); *C10M 2205/028* (2013.01); *C10M 2205/0285* (2013.01); *C10M 2207/026* (2013.01); *C10M 2207/26* (2013.01); *C10M 2207/282* (2013.01); *C10M 2207/2855* (2013.01); *C10M 2215/064* (2013.01); *C10M 2215/222* (2013.01);

(Continued)

(58) Field of Classification Search

USPC ..... 508/479, 480, 481, 482

See application file for complete search history.

(56) References Cited

U.S. PATENT DOCUMENTS 4,543,420 A * 9/1985 Godwin et al. ..... 560/76
6,465,400 B1 10/2002 Kamimura et al.

(Continued)

FOREIGN PATENT DOCUMENTS

CN 1332784 A 1/2002
JP 10 130673 5/1998

(Continued)

OTHER PUBLICATIONS

International Search Report Issued Apr. 19, 2011 in PCT/JP11/56337 Filed Mar. 17, 2011.

(Continued)

*Primary Examiner* — Ellen McAvoy
(74) *Attorney, Agent, or Firm* — Oblon, McClelland, Maier & Neustadt, L.L.P.

(57) ABSTRACT

A lubricating oil composition for high-temperature applications contains (A) a pyromellitate ester, (B) a sulfur-containing triazine antioxidant, and (C) a thiophosphoric acid ester antioxidant. When the lubricating oil composition for high-temperature applications according to the invention is applied to a chain, a gear, a bearing and the like, an amount of evaporation of the lubricating oil composition is restrained for a long time and fluidity thereof is also kept for a long time.

18 Claims, 2 Drawing Sheets

(52) U.S. Cl.
CPC ..... *C10M2215/223* (2013.01); *C10M 2219/09* (2013.01); *C10M 2223/04* (2013.01); *C10M 2223/045* (2013.01); *C10M 2223/047* (2013.01); *C10M 2229/02* (2013.01); *C10N 2230/06* (2013.01); *C10N 2230/10* (2013.01); *C10N 2230/74* (2013.01); *C10N 2240/02* (2013.01); *C10N 2240/04* (2013.01); *C10N 2240/52* (2013.01); *C10M 2207/262* (2013.01); *C10M 2207/2835* (2013.01); *C10M 2207/289* (2013.01); *C10M 2219/02* (2013.01); *C10N 2230/08* (2013.01)

(56) References Cited

U.S. PATENT DOCUMENTS

| | | | | |
|---|---|---|---|---|
| 6,562,766 | B1 * | 5/2003 | Koyama et al. | 508/372 |
| 6,726,855 | B1 * | 4/2004 | Migdal et al. | 252/401 |
| RE39,382 | E * | 11/2006 | Kamimura et al. | 508/378 |
| 7,947,634 | B2 * | 5/2011 | Okazaki | 508/306 |

FOREIGN PATENT DOCUMENTS

| | | |
|---|---|---|
| JP | 2000 1681 | 1/2000 |
| JP | 2000 129279 | 5/2000 |
| JP | 2000 192071 | 7/2000 |
| JP | 2005 314650 | 11/2005 |
| JP | 2007 126519 | 5/2007 |

OTHER PUBLICATIONS

Combined Office Action and Search Report issued Sep. 13, 2013 in Chinese Patent Application No. 201180014517.0 with English language translation and English translation of categories of cited documents.

* cited by examiner

LUBRICATING OIL COMPOSITION FOR HIGH-TEMPERATURE APPLICATIONS

TECHNICAL FIELD

The present invention relates to a lubricating oil composition for high-temperature applications, and more specifically to one to be used for a chain, a roller chain, a chain conveyor, a bearing and the like.

BACKGROUND ART

There are a lot of sliding portions such as a chain, a gear and a bearing inside a tenter used for manufacturing an optical film and a food-packaging film. Since a lubricating oil used in such sliding portions is exposed to high temperatures, an amount of evaporation of the lubricating oil significantly affects a life time of a device. In other words, under such high temperatures, since the lubricating oil loses an inherent viscosity to form a thin film, it is necessary to restrain the amount of evaporation of the lubricating oil in order to keep lubricity thereof. In order to restrain the amount of evaporation, a high-molecular and highly viscous lubricating oil has been typically used for high-temperature applications.

However, such a lubricating oil causes a large power loss although having a small amount of evaporation, which makes overall performance of the lubricating oil unfavorable. Moreover, when such a lubricating oil is exposed to high temperatures while forming a thin film, the lubricating oil becomes solid though a large amount of residue remains. Thus, the lubricating oil not only loses characteristics as a liquid but also blocks a flow of the lubricating oil in a form of a solid sludge, which causes a poor lubrication of the sliding portions. Although such a disadvantage can be simply solved by increasing the amount of the lubricating oil in use, such a solution is not favorable in terms of costs and an environmental aspect. Consequently, as the lubricating oil used under high temperatures, a lubricating oil whose evaporation amount under high temperatures is restrained and whose fluidity is kept for a long time has been demanded. Moreover, in a tenter for manufacturing an optical film, a food-packaging film, a film for a solar battery panel and the like, since scattering of the lubricating oil on a product is extremely disfavored, reduction of the amount of the lubricating oil in use has also been demanded. Further, reduction of electrical power required for operating the device has also been demanded in terms of energy saving.

Accordingly, as such a lubricating oil for high-temperature applications, there has been proposed a lubricating oil composition that contains a polyol ester synthetic oil and a diphenylamine derivative having a $C_{12}$-$C_{72}$ fatty acid and/or an aryl alkyl group having a number average molecular weight of 400 to 800 (see Patent Literature 1).

CITATION LIST

Patent Literature(s)

Patent Literature 1: JP-A-2005-314650

SUMMARY OF THE INVENTION

Problems to be Solved by the Invention

However, even in the lubricating oil composition disclosed in Patent Literature 1, the lubricating oil does not always exhibit sufficient characteristics under high temperatures. For instance, the lubricating oil composition may become solid under high temperatures, or an antioxidant may become sludge to cause an oil path to be clogged.

An object of the invention is to provide a lubricating oil composition for high-temperature applications, in which, under high temperatures and in a thin film, an amount of evaporation of the lubricating oil composition is restrained and fluidity thereof is kept for a long time.

Means for Solving the Problems

In order to solve the above problem(s), the invention provides a lubricating oil composition for high-temperature applications as follows:

(1) a lubricating oil composition for high-temperature applications according to an aspect of the invention containing (A) a pyromellitate ester, (B) a sulfur-containing triazine antioxidant, and (C) a thiophosphoric acid ester antioxidant;

(2) the lubricating oil composition according to the above aspect of the invention further containing (D) an amine antioxidant;

(3) the lubricating oil composition according to the above aspect of the invention further containing (E) a phenol antioxidant;

(4) the lubricating oil composition according to the above aspect of the invention further containing (F) a zinc dithiophosphate antioxidant;

(5) the lubricating oil composition according to the above aspect of the invention, in which a content of the component (A) is 20 mass % or more of a total amount of the composition;

(6) the lubricating oil composition according to the above aspect of the invention further containing at least one of polybutene and a polyalphaolefin;

(7) the lubricating oil composition according to the above aspect of the invention, in which the lubricating oil composition is used under the atmosphere of the temperature of 200 degrees C. or more; and (8) the lubricating oil composition according to the above aspect of the invention, in which the lubricating oil composition is applied to one of a chain, a gear and a bearing.

The invention can provide a lubricating oil composition for high-temperature applications, in which, under high temperatures and in a thin film, the amount of evaporation of the lubricating oil composition is restrained and fluidity thereof is kept for a long time.

DESCRIPTION OF EMBODIMENT(S)

Figure 1:
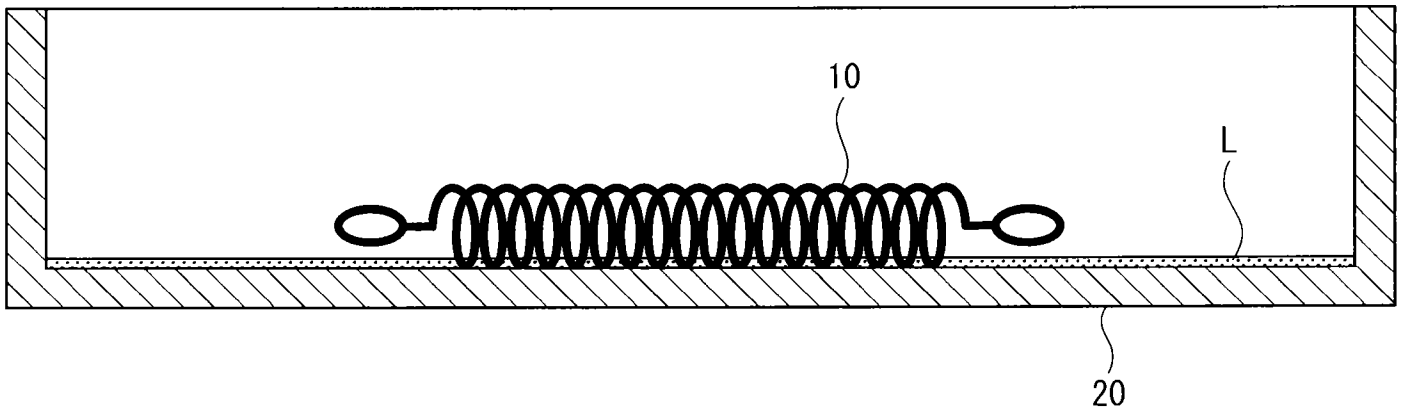
FIG. 1 is a schematic view showing that a sample oil is adhered to a spiral spring in Examples of the invention.

A lubricating oil composition for high-temperature applications according to the invention contains (A) a pyromellitate ester, (B) a sulfur-containing triazine antioxidant, and (C) a thiophosphoric acid ester antioxidant. The invention will be described below in detail.

Component (A)

The component (A) forming the lubricating oil composition for high-temperature applications of the invention (hereinafter, referred to as "the composition") is a pyromellitate ester and corresponds to a base oil of the composition. For instance, a pyromellitate tetraester represented by the following formula (1) is preferably used.

[Formula 1]

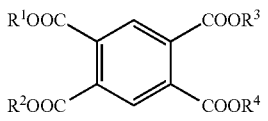

(1)

In the pyromellitate tetraester represented by the formula (1), all functional groups of $R^1$ to $R^4$ are hydrocarbyl groups, which may be mutually the same or different. Each of these functional groups are preferably an alkyl group having 6 to 16 carbon atoms, more preferably 6 to 10 carbon atoms, in terms of evaporativity restraint and fluidity.

Examples of the pyromellitate tetraester represented by the formula (1) include tetra-n-octyl pyromellitate, tetra-3,5,5-trimethylhexyl pyromellitate, tetra-undecyl pyromellitate, and tetraisostearyl pyromellitate. The alkyl group preferably has a linear structure in terms of evaporativity restraint.

A content rate of the component (A) in the composition is preferably in a range of 10 mass % to 99 mass % of a total amount of the composition, more preferably in a range of 20 mass % to 96 mass %. When the content rate falls within the above range, the composition is excellent in a balance between evaporativity restraint and fluidity.

It is preferable that the base oil of the composition further contains polybutene or a polyalphaolefin in terms of thickening effects. When the base oil further contains polybutene or a polyalphaolefin, the composition can be effectively prevented from dropping off a chain and a gear even under high temperatures.

Polybutene is exemplified by a mixture of polyisobutylene and poly-n-butene formed by polymerization of olefins having 4 carbon atoms, preferably having a number average molecular weight of 300 to 1500. Polybutene or polyisobutylene having a number average molecular weight of 400 to 1300 is particularly preferable. The mass average molecular weight (Mn) can be measured by gel-chromatography. A polymer formed by 100% polyisobutylene or 100% poly-n-butene may be used as polybutene.

As the polyalphaolefin, a known alpha-olefin oligomer can be used as it is, or can be used after hydrogenation. As the alpha-olefin, 1-octene, 1-decene, 1-dodecene and 1-tetradecene are usable. As an oligomerization catalyst, a typically used BF3 complex catalyst, solid acid catalyst or metallocene complex catalyst for general purpose may be used. For hydrogenating the oligomer, a typical nickel catalyst such as sponge nickel and nickel diatomite and a noble metal catalyst such as palladium activated carbon or ruthenium activated carbon are preferable. Any types of catalysts including a support catalyst and a complex catalyst are usable. The above polyalphaolefin preferably has a kinematic viscosity at 100 degrees C. approximately in a range of 10 $mm^2/s$ to 400 $mm^2/s$.

When either polybutene or the polyalphaolefin is used alone, a content of either one is preferably 40 mass % or less. When both polybutene and the polyalphaolefin are used in a mixture, a content of the mixture of polybutene and the polyalphaolefin is also preferably 40 mass % or less.

Component (B)

The component (B) forming the composition is a sulfur-containing triazine antioxidant. The sulfur-containing triazine antioxidant is preferably exemplified by 2,6-di-tert-butyl-4-(4,6-bis(octylthio)-1,3,5-triazine-2-ylamino)phenol.

The component (B) exhibits a low evaporativity, and also exhibits excellent anti-oxidation effect and sludge formation prevention effect even under high temperatures by being contained together with a later-described component (C).

A content rate of the component (B) in the composition is preferably in a range of 0.01 mass % to 5 mass % of the total amount of the composition, more preferably in a range of 0.1 mass % to 3 mass %.

Component (C)

The component (C) forming the composition is a thiophosphoric acid ester antioxidant. Examples of a thiophosphoric acid ester include a thiophosphite and a thiophosphate, particularly preferably, an alkyl thiophosphite and an aryl thiophosphate, examples of which include trilauryl trithiophosphite, triphenyl thiophosphate, trinonylphenyl thiophosphate and triphenyl phosphorothioate.

The component (C) exhibits a low evaporativity, and also exhibits excellent anti-oxidation effect and wear resistance even under high temperatures by being contained together with the aforementioned component (B).

A content rate of the component (C) in the composition is preferably in a range of 0.01 mass % to 10 mass % of the total amount of the composition, more preferably in a range of 0.5 mass % to 5 mass %, in terms of the above effects.

Component (D)

By blending an amine antioxidant as the component (D) in the composition, the anti-oxidation effect and the sludge formation prevention effect can be enhanced. The amine antioxidant is exemplified by a diphenylamine antioxidant, examples of which include diphenylamine, monooctyl diphenylamine, monononyl diphenylamine, 4,4'-dibutyl diphenylamine, 4,4'-dihexyl diphenylamine, 4,4'-dioctyl diphenylamine, 4,4'-dinonyl diphenylamine, tetrabutyl diphenylamine, tetrahexyl diphenylamine, tetraoctyl diphenylamine, tetranonyl diphenylamine, and 4,4'-bis(α,α-dimethylbenzyl)diphenylamine. The amine antioxidant is also exemplified by a naphthylamine antioxidant, examples of which include α-naphthylamine, phenyl-α-naphthylamine, butylphenyl-α-naphthylamine, hexylphenyl-α-naphthylamine, octylphenyl-α-naphthylamine, and nonylphenyl-α-naphthylamine. Among the above, the diphenylamine antioxidant is preferred to the naphthylamine antioxidant in terms of the effects.

A content rate of the component (D) in the composition is preferably in a range of 0.01 mass % to 10 mass % of the total amount of the composition, more preferably in a range of 0.1 mass % to 5 mass %, in terms of the above effects.

Component (E)

In the invention, a phenol antioxidant is preferably contained as the component (E) in terms of the anti-oxidation effect and the sludge formation prevention effect. Preferable examples of the phenol antioxidant include 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl) phenol, 2,6-di-tert-amyl-4-methylphenol, 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,4-dimethyl-6-tert-butylphenol, 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl) sulfide, bis(3,5-di-tert-butyl-4-hydroxybenzyl) sulfide, 2,2'-thio-diethylenebis[3-(3,5-di-tert-butyl-4-hydroxyphenyl)propionate], tridecyl-3-(3,5-di-tert-butyl-4-hydroxyphenyl)propionate, pentaerythrityl-tetraxis[3-(3,5-di-tert-butyl-4-hydroxyphenyl)propionate], octyl-3-(3,5-di-tert-butyl-4-hydroxyphenyl)propionate, octadecyl-3-(3,5-di-tert-butyl-4-hydroxyphenyl)propionate, and octyl-3-(3-methyl-5-tert-butyl-4-hydroxyphenyl)propionate.

A content rate of the component (E) in the composition is preferably in a range of 0.01 mass % to 10 mass % of the total amount of the composition, more preferably in a range of 0.1 mass % to 5 mass %, in terms of the above effects.

Component (F)

In the invention, the composition exhibits more excellent anti-oxidation effect and wear resistance even under high temperatures by containing a zinc dithiophosphate antioxidant as the component (F).

The zinc dithiophosphate antioxidant is exemplified by ZnDTP represented by the following formula (2).

[Formula 2]

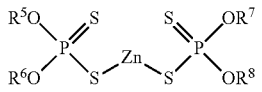

(2)

In the formula (2), $R^5$, $R^6$, $R^7$ and $R^8$ each represent a primary or secondary alkyl group having 3 to 22 carbon atoms or a substituent selected from alkylaryl groups substituted by an alkyl group having 3 to 18 carbon atoms. $R^5$, $R^6$, $R^7$ and $R^8$ may be mutually the same or different.

In the invention, one of the ZnDTP may be used alone or two or more thereof may be used in combination. Particularly, ZnDTP containing zinc dithiophosphate of a secondary alkyl group as the main component is preferable for enhancing wear resistance.

Examples of the ZnDTP are zinc dipropyl dithiophosphate, zinc dibutyl dithiophosphate, zinc dipentyl dithiophosphate, zinc dihexyl dithiophosphate, zinc diisopentyl dithiophosphate, zinc diethylhexyl dithiophosphate, zinc dioctyl dithiophosphate, zinc dinonyl dithiophosphate, zinc didecyl dithiophosphate, zinc didodecyl dithiophosphate, zinc dipropylphenyl dithiophosphate, zinc dipentylphenyl dithiophosphate, zinc dipropylmethylphenyl dithiophosphate, zinc dinonylphenyl dithiophosphate, zinc didodecylphenyl dithiophosphate and zinc didodecylphenyl dithiophosphate.

A content rate of the component (F) in the composition is preferably in a range of 0.01 mass % to 10 mass % of the total amount of the composition, more preferably in a range of 0.02 mass % to 5 mass %, in terms of the above effects.

The composition may further contain various additives such as a detergent dispersant, a metal deactivator, and an antifoaming agent as long as the effects of the invention are not impaired.

The detergent dispersant is classified into a metal detergent and an ashless dispersant. Examples of the ashless dispersant include polybutenyl succinimide, polybutenyl benzylamine, and polybutenyl amine, each of which has a polybutenyl group having a number average molecular weight of 900 to 3500, and a derivative of a boron-modified substance and the like of those. One of the ashless dispersants may be contained alone or any two or more thereof may be contained in combination. A content of the ashless dispersant(s) is typically in a range of 0.01 mass % to 10 mass % of the total amount of the composition. Examples of the metal detergent include a sulfonate, a phenate, a salicylate and a naphthenate of an alkali metal (e.g., sodium (Na) and potassium (K)) or an alkaline earth metal (e.g., calcium (Ca) and magnesium (Mg)). One of the metal detergents may be used alone, or two or more thereof may be used in combination. A total base number and a content of the metal detergent(s) may be selected as needed depending on required performance of the lubricating oil. The total base number is typically 500 mgKOH/g or less according to a perchloric acid method, desirably in a range of 10 mgKOH/g to 400 mgKOH/g. A content of the metal detergent(s) is typically in a range of 0.1 mass % to 10 mass % or more of the total amount of the composition.

Examples of the metal deactivator include benzotriazole, a triazole derivative, a benzotriazole derivative and a thiadiazole derivative. A content of the metal deactivator is typically in a range of 0.01 mass % to 3 mass % or more of the total amount of the composition.

As the antifoaming agent, a liquid silicone is suitable, and a methylsilicone, a fluorosilicone, a polyacrylate and the like are usable. A content of the antifoaming agent is preferably in a range of 0.0005 mass % to 0.1 mass % of the total amount of the composition.

In the lubricating oil composition for high-temperature applications according to the invention, the amount of evaporation is significantly reducible and fluidity is maintainable for a long time, under high temperatures and in a thin film. The lubricating oil composition is suitably applicable to a chain, a chain roller, a chain conveyor, a bearing and the like used in a high-temperature furnace, a drying furnace, panelboard manufacturing equipment, a chemical fiber tenter, a resin film tenter and the like.

EXAMPLES

Next, the invention will be further described in detail with reference to Examples and Comparatives, which by no means limit the invention.

Examples 1 to 5 and Comparatives 1 to 4

(1) Preparation of Sample Oil

Base oils and additives described below were mixed at a predetermined content to prepare a lubricating oil composition, which was provided as a sample oil. Blend compositions are shown in Table 1.

(1.1) Base Oil

Base Oil 1: Pyromellitate Ester (Component A)

(a tetraester mixture containing a linear alkyl group having 6 to 10 carbon atoms)

Base Oil 2: Trimellitic Acid Ester (a triester containing a linear alkyl group having 10 carbon atoms as an alcohol residue)

Base Oil 3: Polyalphaolefin (PAO)

(Kinematic Viscosity at 100 degrees C.: 10 $mm^2/s$)

Base Oil 4: Polybutene (Kinematic Viscosity at 100 degrees C.: 800 $mm^2/s$)

(1.2) Additive (1.2.1) Sulfur-containing Triazine Antioxidant (Component B):

2,6-di-tert-butyl-4-(4,6-bis(octylthio)-1,3,5-triazine-2-ylamino)phenol (1.2.2) Thiophosphoric Acid Ester Antioxidant (Component C):

trinonylphenylthiophosphate (1.2.3) Amine Antioxidant (Component D):

4-4'-bis(α,α-dimethylbenzyl)diphenylamine (1.2.4) Phenol Antioxidant (Component E):

octadecyl-3-(3,5-di-tert-butyl-4-hydroxyphenyl)propionate (1.2.5) Zinc Dithiophosphate Antioxidant (Component F):

ZnDTP (an alkyl group: a primary hexyl group (1.2.6) Other Additives:

Detergent Dispersant: Ca salicylate

Metal deactivator: benzotriazole

Antifoaming Agent: silicone antifoaming agent

TABLE 1

| | | | | Ex. 1 | Ex. 2 | Ex. 3 | Ex. 4 | Ex. 5 | Comp. 1 | Comp. 2 | Comp. 3 | Comp. 4 |
|---|---|---|---|---|---|---|---|---|---|---|---|---|
| blend composition (mass %) | base oil | pyromellitate ester (component A) | | remnant | remnant | remnant | remnant | remnant | — | — | remnant | remnant |
| | | trimellitic acid ester | | — | — | — | — | — | remnant | — | — | — |
| | | PAO | | — | — | — | — | — | | remnant | — | — |
| | | polybutene | | 22.54 | 22.53 | 22.43 | 22.43 | 22.30 | 25.00 | — | 22.54 | 22.89 |
| | antioxidant | sulfur-containing triazine antioxidant (component B) | | 0.5 | 0.5 | 0.5 | 0.5 | 0.5 | 0.5 | 0.5 | — | 0.5 |
| | | thiophosphoric acid ester antioxidant (component C) | | 2.0 | 2.0 | 2.0 | 2.0 | 2.0 | 2.0 | 2.0 | 2.0 | — |
| | | amine antioxidant (component D) | | — | — | 0.5 | — | 0.5 | 0.5 | 0.5 | 0.5 | 0.5 |
| | | phenol antioxidant (component E) | | — | — | — | 0.5 | 0.5 | — | — | — | — |
| | | zinc dithiophosphate antioxidant (component F) | | — | 0.05 | — | — | 0.05 | — | — | — | — |
| | others | detergent dispersant (Ca salicylate) | | 0.54 | 0.54 | 0.54 | 0.54 | 0.54 | 0.54 | 0.54 | 0.54 | 0.54 |
| | | metal deactivator (benzotriazole) | | | | | | | | | | |
| | | antifoaming agent (silicone antifoaming agent) | | | | | | | | | | |
| evaluation results | friction/wear test | coefficient of kinetic friction | | 0.12 | 0.11 | 0.12 | 0.12 | 0.11 | 0.13 | 0.14 | 0.12 | 0.14 |
| | | wear scar diameter (mm) | | 0.72 | 0.40 | 0.72 | 0.72 | 0.39 | 0.78 | 0.80 | 0.70 | 0.82 |
| | thin film residue test | 190° C. | residual oil rate after test | 96% | 97% | 97% | 97% | 97% | 95% | 95% | 98% | 97% |
| | | 20 H | fluidity after test | A | A | A | A | A | A | A | A | A |
| | | 210° C. | residual oil rate after test | 93% | 93% | 94% | 93% | 95% | 88% | 81% | 84% | 92% |
| | | 20 H | fluidity after test | A | A | A | A | A | A | B | A | A |
| | | 230° C. | residual oil rate after test | 88% | 88% | 90% | 89% | 91% | 67% | 51% | 75% | 87% |
| | | 20 H | fluidity after test | A | A | A | A | A | B | C | C | A |
| | spring adhesion test (mass (g) of a weight when a spring is stretched) | | | — | — | — | — | 60 | 180 | 120 | — | — |

(2) Evaluation Method

The above sample oils were evaluated according to the following method. Results are shown in Table 1.

Friction/Wear Test

The friction test for the sample oils was conducted with a ball-on-disc SRV reciprocating tester (manufactured by Optimol Ltd.) under the following conditions.

1) Test Piece

Ball material: 10 mm diameter, 52100 steel, Rc=60±2, Ra=0.025±0.005 μm

Disc material: 24 mm diameter, 7.85 mm thickness, 52100 steel, Rc=60±2, Rz=0.5 μm 2) Amplitude: 1 mm 3) Frequency: 50 Hz 4) Load: 200 N 5) Temperature: 190 degrees C.

6) Testing time: 1 hour

7) Measurement items: coefficient of kinetic friction and wear scar width after the test 8) Measurement method: While a test ball (steel ball) was reciprocated on the test piece, a coefficient of kinetic friction was measured. A wear scar size on the test piece was measured in the X (lateral) direction and the Y (longitudinal) direction using a microscope, and the obtained values were averaged to provide a wear width (m).

Thin Film Residue Test

Residual Oil Rate

A container and a thermostat air bath for the thermal stability test of lubricating oils (JIS K 2540) were used. A sample oil (1 g) was put in the container and was left to stand still for 20 hours at three temperatures of 190 degrees, 210 degrees C. and 230 degrees C. Subsequently, a residue of the sample oil was measured. The residue was divided by the original amount of the sample oil, and the obtained value was represented in percentage to provide a residual oil rate (%). Note that air was arranged to flow into the thermostat air bath at a flow rate of 10 L/hr.

Fluidity

In the above test, after calculating the residual oil rate, the container was inclined by 45 degrees. Fluidity of the residual oil (thin film residue) was evaluated based on the following scale.

A: The residual oil does not adhere and drops off the container within 15 minutes.

B: A part of the residual oil adheres while another part thereof drops off the container within 15 minutes.

C: The residual oil adheres and does not drop off the container even after the elapse of 15 minutes.

Spring Adhesion Test

As shown in FIG. 1, a metal spiral spring 10 (a diameter of a wire: 0.3 mm, an outer diameter: 3 mm, an entire length: 20 mm, a spring constant: 90 N/m) was mounted in a stainless-steel container 20 of a 50 mm inner diameter and a 10 mm depth. Subsequently, the spiral spring 10 was rolled over while being coated by a 0.5 g sample oil L, so that the sample oil L was entirely adhered to a spiral portion of the spiral spring 10 (i.e., a spiral portion of the spiral spring 10 was entirely covered with an oil film of the sample oil). Next, the spiral spring 10, together with the stainless-steel container 20, was left to stand still for 20 hours within a thermostat air bath (i.e., the air bath used in the thin film residue test) in which the temperature was set at 250 degrees C. Subsequently, the spiral spring 10 was taken out of the air bath and was brought back to ordinary temperatures. At this stage, the sample oil L adhering to the spiral spring 10 was half dried.

Figure 2:
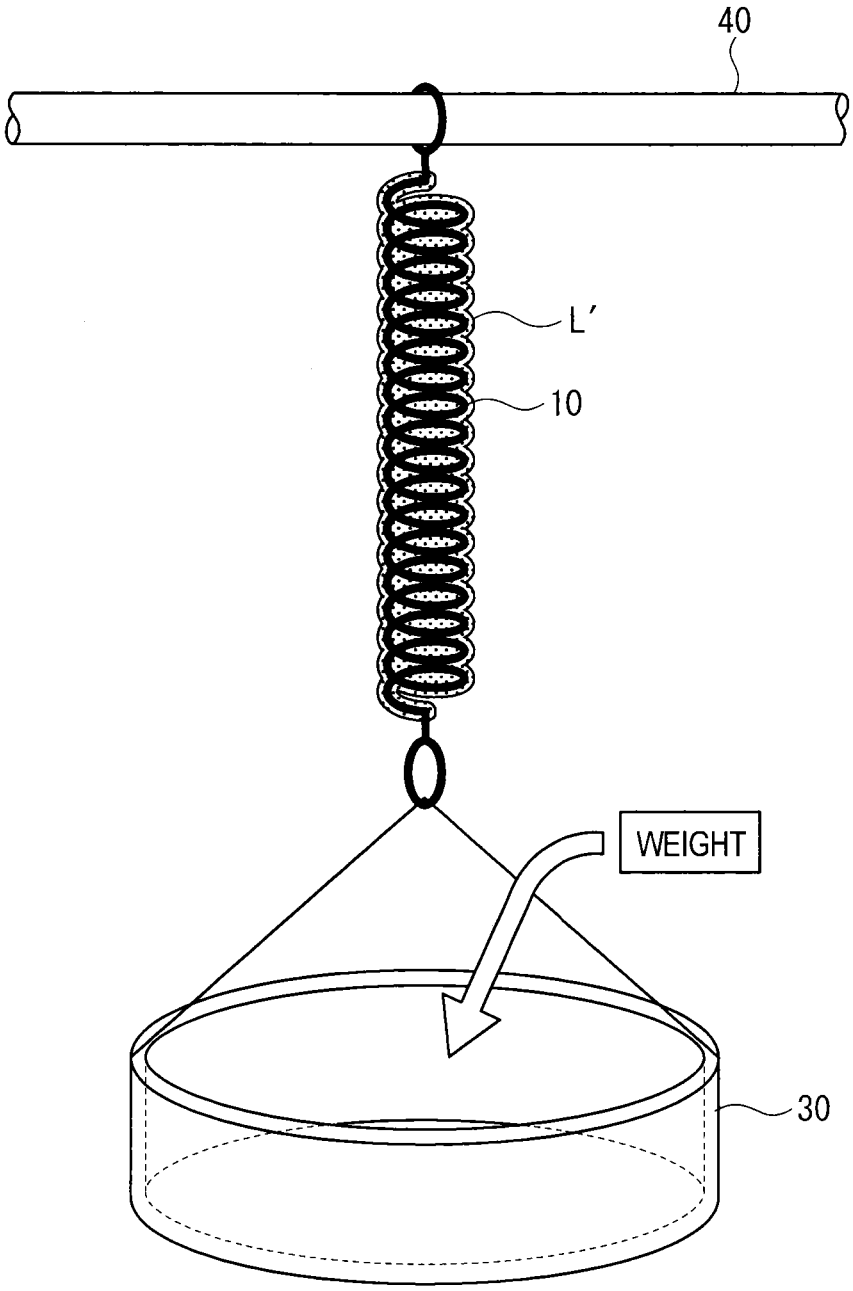
FIG. 2 is a schematic view showing a spring adhesion test in Examples of the invention.

Next, as shown in FIG. 2, the spiral spring 10 to which half-dried sample oil L' adhered was hanged on a hanging bar 40. A plastic container 30 having a mass of 50 g was hanged at the bottom of the spiral spring 10. A weight having a mass of 10 g was put into the plastic container 30 one by one until the spiral spring 10 suddenly began to be stretched (i.e., until the half-dried sample oil L' was cracked or broken). When the spiral spring 10 suddenly began to be stretched, a mass of the weight and the container 30 was calculated. In terms of the lubricating oil, it is preferable that the spring is stretched to the maximum soon after the empty plastic container 30 (mass of 50 g) is hanged.

Note that the spring adhesion test was conducted only for the sample oils of Example 5, Comparative 1 and Comparative 2.

Evaluation Results

From the results of Table 1, in all the sample oils of Examples 1 to 5 according to the invention, lubricity and wear resistance at high temperatures are, of course, excellent and the amount of evaporation is restrained in a thin film and under high temperatures while fluidity is kept for a long time. Accordingly, by using the lubricating oil composition for high-temperature applications according to the invention, a life time and a maintenance interval of a high thermal device (e.g., a chain and a bearing driven in an oven) can be prolonged. Moreover, reduction of power consumption required for operating the high thermal device can contribute to cost saving and energy saving.

On the other hand, in Comparatives 1 and 2, since the component (A) is not used as the base oil, the amount of evaporation is extremely large and fluidity declines in a short period of time in a thin film and under high temperatures. Moreover, lubricity and wear resistance are also poor. In Comparative 3, since the component (B) is not contained as an additive, fluidity under high temperatures declines in a short period of time. In Comparative 4, since the component (C) is not contained as an additive, lubricity and wear resistance are poor.

The invention claimed is:

1. A lubricating oil composition, comprising:

(A) a pyromellitate ester represented by the formula (1):

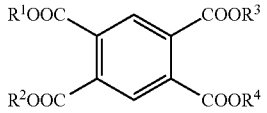

(1)

wherein $R^1$ to $R^4$ are each, independently, a hydrocarbyl group;

(B) a sulfur-containing triazine antioxidant;

(C) a thiophosphoric acid ester antioxidant; and at least one of a polybutene having a number-average molecular weight of 400 to 1300 and a polyalphaolefin.

2. The composition of claim 1, further comprising:

(D) an amine antioxidant.

3. The composition of claim 1, further comprising:

(E) a phenol antioxidant.

4. The composition of claim 1, further comprising:

(F) a zinc dithiophosphate antioxidant.

5. The composition of claim 1, wherein a content of the pyromellitate ester (A) is 20 mass% or more of a total amount of the composition.

6. The composition of claim 1, which is suitable for lubrication at 200 degrees C. or more.

7. The composition of claim 1, which is suitable for application to a chain, a gear and a bearing.

8. The composition of claim 2, further comprising:

(E) a phenol antioxidant.

9. The composition of claim 2, further comprising:

(F) a zinc dithiophosphate antioxidant.

10. The composition of claim 3, further comprising:

(F) a zinc dithiophosphate antioxidant.

11. The composition of claim 2, wherein a content of the pyromellitate ester (A) is 20 mass% or more of a total amount of the composition.

12. The composition of claim 3, wherein a content of the pyromellitate ester (A) is 20 mass% or more of a total amount of the composition.

13. The composition of claim 4, wherein a content of the pyromellitate ester (A) is 20 mass% or more of a total amount of the composition.

14. The composition of claim 1, which is suitable for high temperature applications.

15. The composition of claim 2, which is suitable for lubrication at 200 degrees C. or more.

16. The composition of claim 3, which is suitable for lubrication at 200 degrees C. or more.

17. The composition of claim 1, which contains the polybutene having a number-average molecular weight 400 to 1300.

18. The composition of claim 1, which contains the polyalphaolefin.

* * * * *